US006019661A

United States Patent [19]

Simpkins

[11] Patent Number: 6,019,661

[45] Date of Patent: Feb. 1, 2000

[54] MOVEABLE TOY ASSEMBLY

[76] Inventor: Danny Simpkins, 7660 Beverly Blvd. Apt 433, L.A., Calif. 90036-2746

[21] Appl. No.: 09/100,553

[22] Filed: Jun. 19, 1998

[51] Int. Cl.[7] ..... A63H 21/02

[52] U.S. Cl. ..... 446/228; 446/377

[58] Field of Search ..... 446/3, 228, 377, 446/487, 489, 490

[56] References Cited

U.S. PATENT DOCUMENTS

| | | | |
|---|---|---|---|
| 182,194 | 9/1876 | Hubbell | 446/228 |
| 1,234,885 | 7/1917 | Dyer | 446/228 |
| 1,538,217 | 5/1925 | Sears | 446/228 |
| 2,219,831 | 10/1940 | Winter | 446/228 |
| 2,469,058 | 5/1949 | Sullivan | 446/228 |
| 2,469,449 | 5/1949 | Baskin, Jr. | 446/228 X |
| 2,634,127 | 4/1953 | Shapiro | 446/228 X |
| 2,969,608 | 1/1961 | Shapiro | 446/288 |
| 3,044,737 | 7/1962 | Vavra | 446/228 X |
| 3,600,843 | 8/1971 | Becker | 446/228 |
| 4,664,389 | 5/1987 | Barclay et al. | 446/228 X |
| 4,915,394 | 4/1990 | Kramer | 446/228 X |
| 5,316,301 | 5/1994 | Boury | 446/228 X |

*Primary Examiner*—Sam Rimell
*Attorney, Agent, or Firm*—Knoble & Yoshida LLC

[57] ABSTRACT

A moveable toy assembly is provided. The assembly comprises a body having a top portion, lower portion, front portion, and back portion. A first attaching member is coupled proximate the top portion and adapted to moveably couple with a thread material. A thread material having a first end and opposing second end is provided to enable the toy body to travel along the length of the thread as a force is applied to the thread material. The first end of the tread is adapted to couple with a first support member. The second end is adapted to be coupled to a second support member.

14 Claims, 4 Drawing Sheets

MOVEABLE TOY ASSEMBLY

FIELD OF THE INVENTION

The present invention is related to moveably toy figures and more particularly to toy figures whose movement is generated by the vibration of a thread of material.

BACKGROUND OF THE INVENTION

Toy figures whose movement is generated by a thread of material that is in communication with the figure are well known in the art. Typical toy figures include puppets whose movement is generated by a person pulling on, or otherwise manipulating, a number of strings which are attached to various parts of the puppets body. These types of toys may be made of wood or other hard material. In order for a person to manipulate a toy figure of this type to get the figure to display fluid motion, the operator must be relatively close to the strings of the puppet. These types of toys, however, have several drawbacks.

One such drawback is that a person must possess a relatively high degree of skill for the toy figure to display a fluid motion. It would, therefore, be desirable to provide a toy figure that a can be manipulated by a person to display fluid motion with the person possessing a low level of skill.

Another drawback is that as the strings are pulled, it is likely that an audience would be aware that there is someone operating the puppet's strings, thereby, watching without the illusion that the toy figure is operating under its own power. It would, therefore, be desirable to provide a toy figure that moves with the illusion that it is operating under its own power.

Another drawback is that the cost of the materials that are employed to manufacture a toy figure of this type are relatively expensive. It would, therefore, be desirable, to provide a toy figure whose movement is generated by a thread of material that is relatively inexpensive.

Yet another drawback is that a these types of toy figures are relatively difficult and costly to assemble. It would, therefore, be desirable to provide a more economical and cost effective toy of this general type.

SUMMARY OF THE INVENTION

A moveable toy assembly is provided. The assembly comprises a body having a top portion, lower portion, front portion, and back portion. A first attaching member is coupled proximate the top portion and adapted to moveably couple with a thread material. A thread material having a first end and opposing second end is provided to enable the toy body to travel along the length of the thread as a force is applied to the thread material. The first end of the tread is adapted to couple with a first support member. The second end is adapted to be coupled to a second support member.

DETAILED DESCRIPTION OF THE PREFERRED EMBODIMENTS

Figure 1:
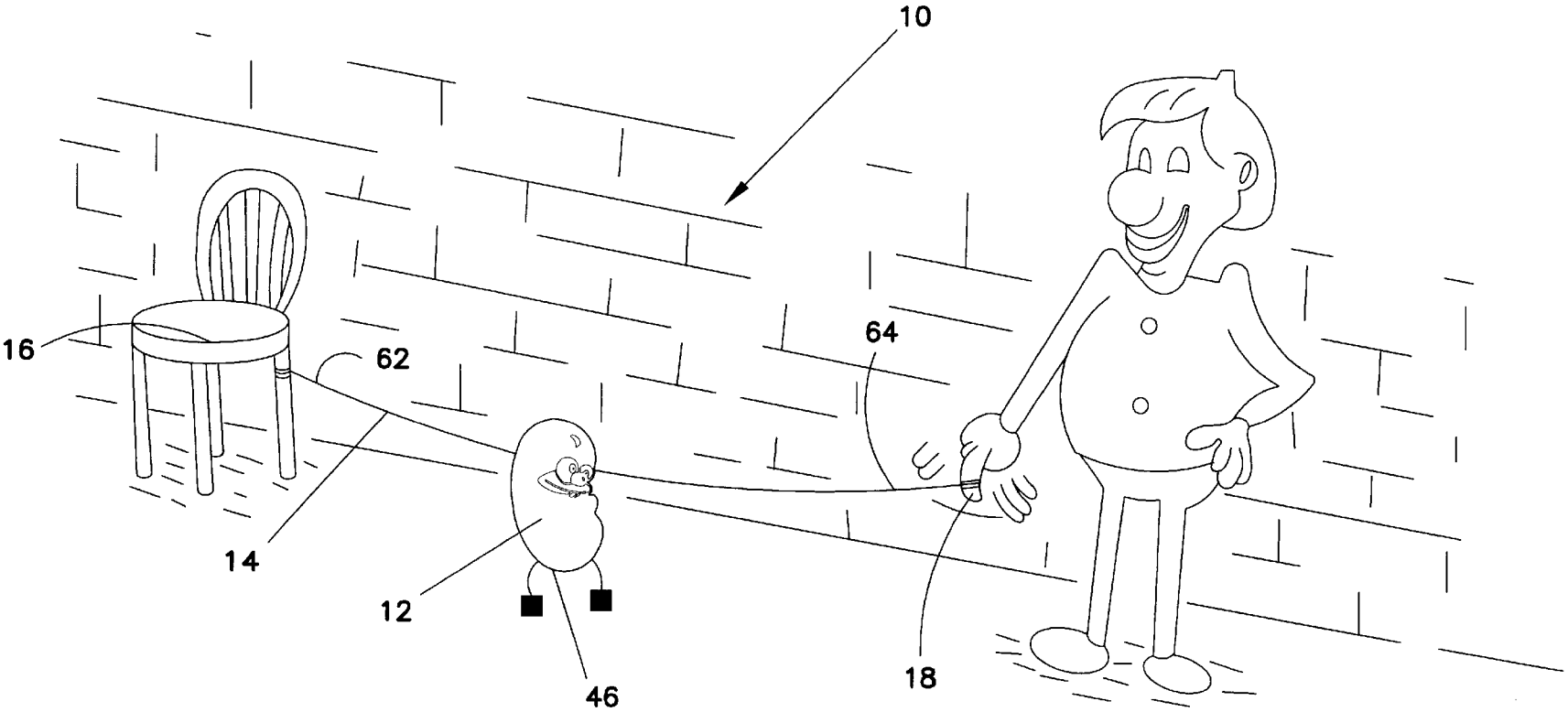
FIG. 1 is a perspective view of a toy figure assembly wherein the toy figure's movement is generated by the movement of a threaded material in accordance with the present invention.
Figure 2:
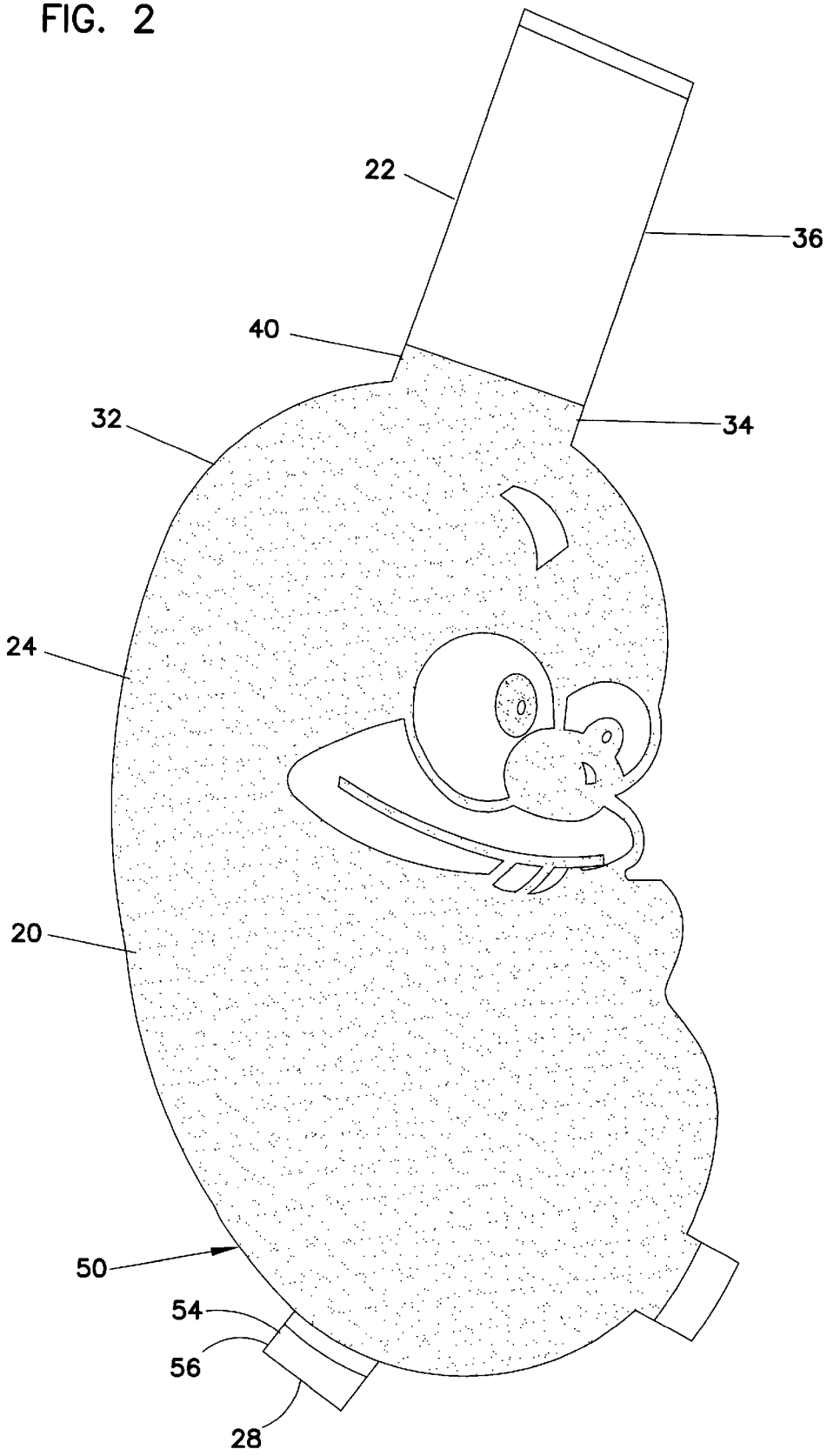
FIG. 2 is a perspective view of a toy figure shown in FIG. 1.
Figure 3:
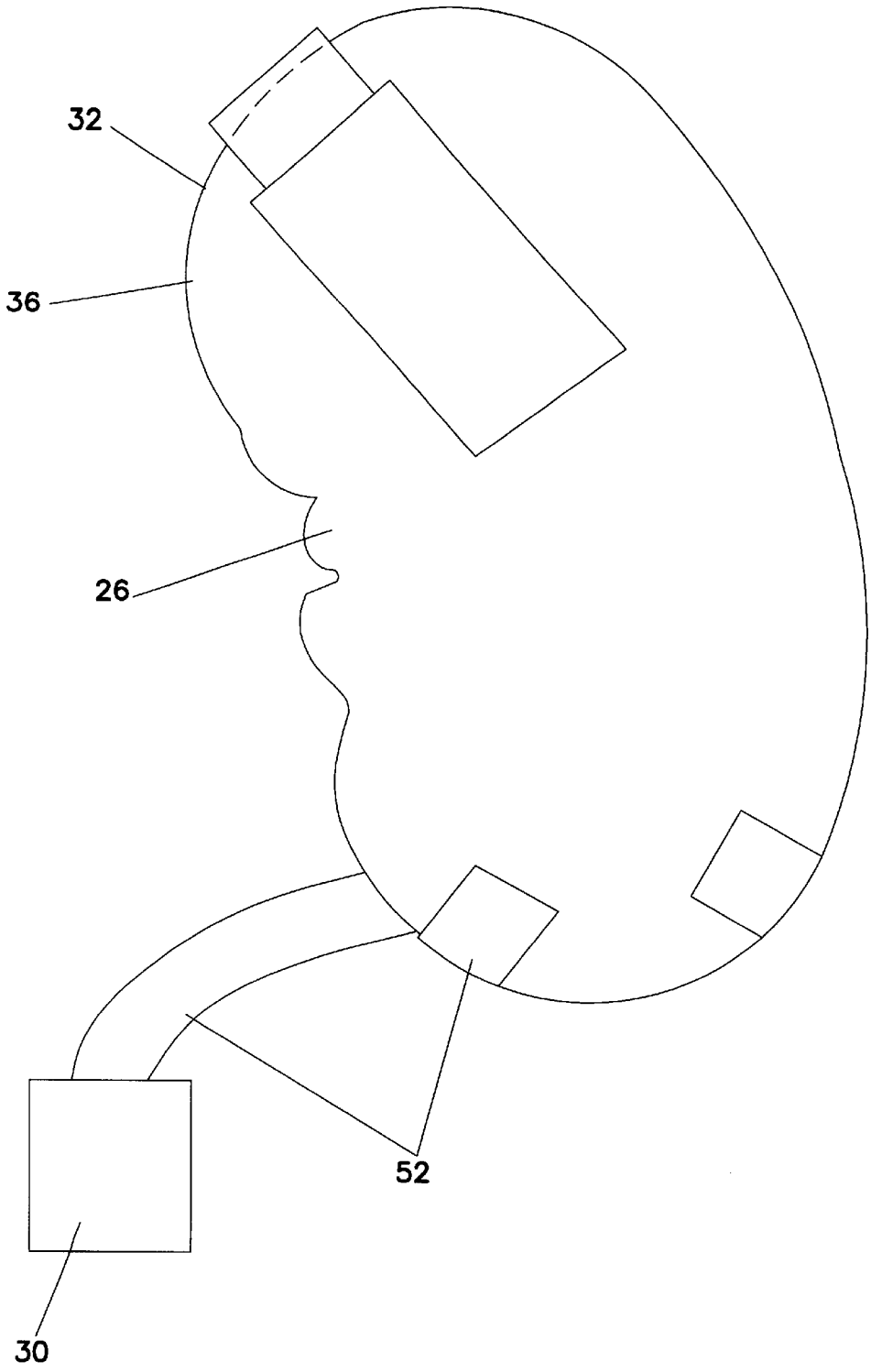
FIG. 3 is a rear view of the toy figure shown in FIG. 2.

FIG. 1 illustrates a preferred embodiment of a movable toy assembly 10 in accordance with the present invention.

The toy assembly 10 comprises a toy body 12, thread material 14, first support member 16 for supporting one end of the thread material 62 and a second support member 18 for supporting a second end 64 of the thread material 14.

Figure 4:
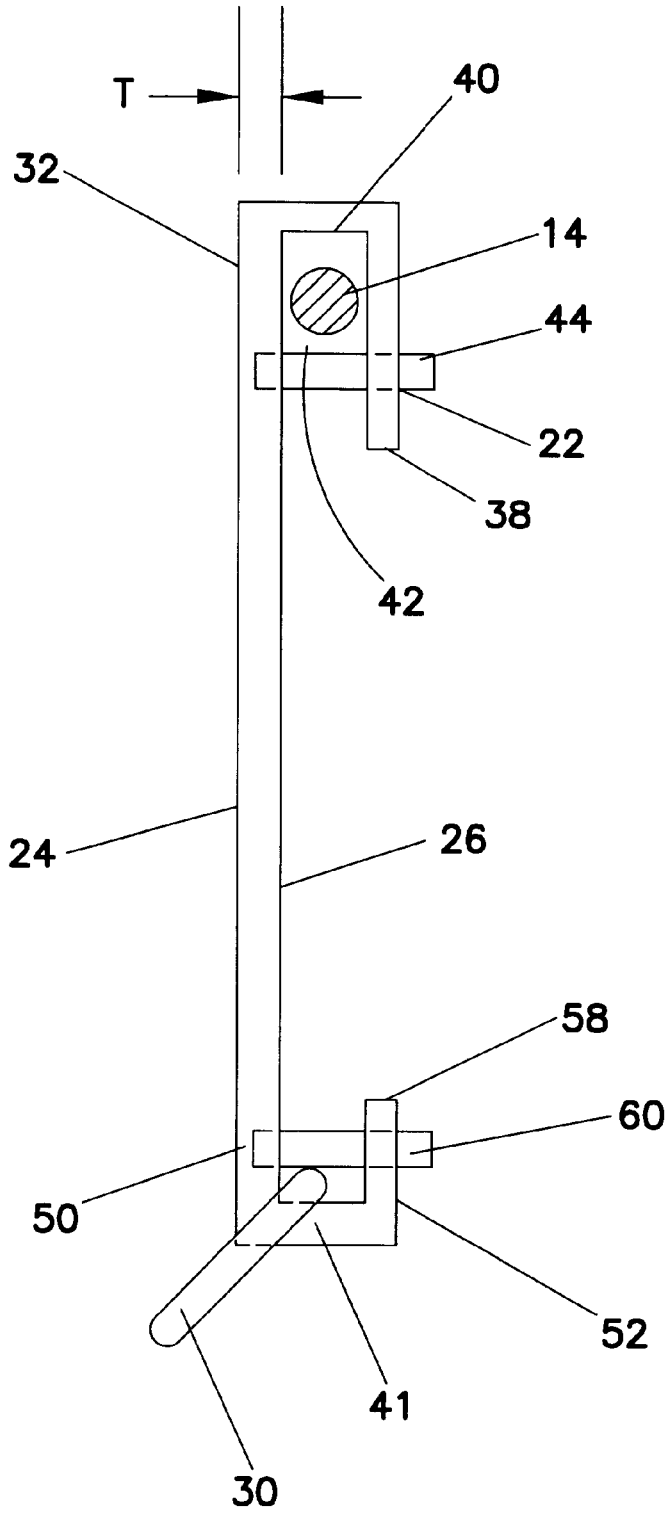
FIG. 4 is a side view of the toy figure shown in FIG. 1.

Referring to FIGS. 1 through 4, the preferred embodiment of the toy body 12 is shown. The toy body 12 can take almost any shape to form any number of figures. Preferably, the toy body 12 has an oblong shape, or a shape of a bean, which is substantially symmetrical along a relative horizontal axis 20. As shown in FIG. 4, the body 12 also has a substantially thin body thickness $T_{body}$. These body characteristics provide the toy body with the desirable balancing and moving abilities when the toy body 12 cooperates with the thread material 14 as discussed in more detail below. Preferably, the toy body is made of a relatively lightweight, flexible, resilient material, such as paper, flexible plastic, and the like.

Preferably, the toy body 12 comprises a first attaching member 22, front portion 24, back portion 26, second attaching member 28, and legs 30. Preferably, the first attaching member 22 is integrally formed proximate the top portion 32 of the toy body 12 and adapted to fold along a fold line 34 from a first position 36 to a second coupling position 38. More preferably, the attaching member 22 and toy body are unitarily formed from the same piece of material. Preferably, the attaching member 22 is adapted to be folded towards the back portion 26 of the toy body such that the toy body 12 can movably cooperate with the thread material 14, as shown in FIG. 1. Preferably, the fold line 34 is formed such that when the first attaching member 22 is folded to the back portion 26 of the toy body 12, a hinge member 40 is formed which creates a space or gap 42 between the first attaching member 22 and the back portion 26 of the toy body 12. The gap 42 provides the necessary clearance which the thread material 14 is positioned to enable the toy body 12 to move along the thread material easily and with little resistance or drag as discussed in more detail below.

The first attaching member 22 is preferably secured to the back portion 26 of the toy body 12 by a fastening member or material 44, such as a staple, an adhesive substrate, or adhesive layer which is applied between the attaching member 22 and back portion 26 of the toy body 12. An adhesive layer can be applied to the first attaching member 22, or on the back portion 26 of the toy body 12, or both such that when the attaching member 22 is folded to the second position 38, the attaching member 22 contacts the adhesive, thereby securing the attaching member 22 in the second position 38. With the attaching member 22 securely positioned in the second coupling position 38, the thread material 14 is passed through the gap 42, between the attaching member 22 and the back portion 26 of the toy body 12 such that the toy body 12 can move from a first position 46 to a second position 48 along the thread material 14 and then back again.

It is noted that other equivalent types of attaching members may be employed to enable the toy body to moveably cooperate with the thread material. These equivalents can be separate members which are coupled to the toy body to achieve the same result as what is described herein.

Preferably, the toy body 12 comprises a pair of legs 30 which are coupled to the lower portion 50 of the toy body 12. Preferably, the legs 30 are formed from a single, flexible material, such as a string of yarn, a thin rubber material, and the like, such that when the material is coupled to the lower portion 50 of the toy body 12, two movable legs 30 are formed. Preferably, the legs are attached proximate the back portion 26 of the toy body 12 by a second attaching member 52. Preferably, the second attaching member 52 is integrally formed proximate the lower portion 50 of the toy body 12 and adapted to fold along a second fold line 54 from a first position 56 to a second coupling position 58. In this position, a hinge member 41 is formed. More preferably, the second attaching member 52 is unitarily formed with the toy body 12 from the same piece of material. Preferably, the second attaching member 52 is adapted to fold to the back portion 26 of the toy body such that the legs 30 can be movably coupled between the back portion of the toy body and the attaching member 52.

The second attaching member 52 is preferably secured proximate the back portion 26 of the toy body 12 by a fastening member or material 60, such as a staple, adhesive substrate, or an adhesive layer which is applied between the attaching member 52 and back portion 26 of the toy body. An adhesive layer can be applied to the second attaching member 52, or the back portion 26 of the toy body or both such that when the second attaching member 26 is folded to the second position 58, the attaching member 52 contacts the adhesive, thereby securing the second attaching member 52 in the second position 58 with the legs secured between the second attaching member 52 and the back portion 26 of the toy body.

It is noted that other equivalent attaching members may be provided to enable the legs to be fastened to the toy body. These equivalents can be separate members, which are coupled to the toy body to achieve the same result as what is described herein.

The thread material 14, is preferably a relatively thin, transparent, flexible material, that when viewed from a distance, it appears to be invisible to the naked eye. The thread material has a first end 62 which is adapted to couple to the first support member 16, and a second end 64 which is adapted to be coupled to the second support member 18. The thread material 14 preferably is of a length which enables the thread to be attached to the first and second support members which are separated at a distance sufficient to enable the toy body to travel as desired.

Preferably, the first support member 16 is an object that is common place in a room so that when the thread material is coupled to the first support member, an audiences attention will most likely not be drawn to the first support member 16. Preferably, the first support member is a chair.

Similarly, the second support member 18 is an object that would not generally draw an audiences attention, thereby, having the audience maintain its attention on the toy body 12 as the toy body moves along the thread material. Preferably, the second support member 18 is an operators hand, finger, foot or other body part, such that when the second support member moves, a force is transferred to the thread material which, in turn, actuates the toy body to move from the first position 46 to the second position 48. It is noted that the second support member can be a rod or other object that can couple with the thread and transfer a force along the thread, thereby, actuating the toy body along the thread material.

In operation, the first attaching member 22 is folded along the fold line 34 to the back portion 26 of the toy body 12 with the thread material 14 within the gap 42, between the first attaching member 22 and the back portion 26 of the toy body 12. The first attaching member 26 is coupled to the back portion 26 with a staple. One end 62 of the thread 14 is attached to first support member 16. Another end 64 of the thread 14 is attached to the operator's finger, such that the thread is taught and the hinge 40 rests on the thread material 14. The operator moves his finger such that a force is transferred to the thread 14, which, in turn, moves the toy body 12, thereby giving appearance that the toy body 12 is moving on its own power from the first position 36, to the second position 38.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A moveable toy assembly comprising:

a body having a top portion, lower portion, front portion, and back portion;

a first attaching member unitarily formed proximate said top portion such that said first attaching member is adapted to fold along a fold line such that a gap is formed between said first attaching member and said body;

a thread material having a first end and opposing second end, said first end adapted to couple with a first support member, and said second end adapted to be coupled to a second support member, said thread material adapted pass through said gap to enable the body travel from a first position to a second position along said thread material;

a first support member adapted to be securely coupled to the first end of the thread material; and a second support member adapted to securely couple with the second end of the thread material; whereby, when a force is applied to the thread material, a the force is transferred to the body thereby moving the body from the first position to the second position.

2. The assembly in claim 1, wherein said body has an oblong shape which is substantially symmetrical along a horizontal axis between said top portion of the body and lower portion of the body.

3. The toy assembly in claim 1, wherein said body is made of a relatively lightweight, flexible, resilient material.

4. The body in claim 1 further comprising:

at least two moveable legs coupled to the lower portion of the body.

5. The body in claim 4 wherein said at least one leg is formed from a single, flexible material, such that when the material is coupled to the lower portion of the body, the at least two moveable legs are capable of moving freely as the body travels along the thread material from the first position to the second position.

6. The body in claim 4 further comprising a second attaching member unitarily formed proximate the bottom portion of the body the second attaching member being adapted to fold to form a gap between said second attaching member and said body such that the legs can be movable coupled between said gap and the body.

7. The assembly in claim 1 wherein said thread material is relatively thin, flexible and transparent such that when the thread material is viewed by the naked eye the material is nearly invisible.

8. A moveable toy assembly comprising:

a body having a top portion, lower portion, front portion, and back portion;

a first attaching member unitarily formed with the body portion such that said first attaching member is adapted to fold to form a gap between said first attaching member and said body, proximate said top portion, said first attaching member adapted to moveably couple with a thread material;

a thread material having a first end and opposing second end, said first end adapted to couple with a first support member, and said second end adapted to be coupled to a second support member, said thread material adapted to pass through said gap to enable the body travel along the thread material from a first position to a second position.

9. The assembly in claim 8, wherein said body has an oblong shape which is substantially symmetrical along a relative horizontal axis.

10. The toy assembly in claim 8, wherein said body is made of a relatively lightweight, flexible, resilient material.

11. The body in claim 8 further comprising:

at least two moveable legs coupled to the lower portion of the body.

12. The body in claim 11 wherein said at least one leg is formed from a single, flexible material, such that when the material is coupled to the lower portion of the body, the at least two moveable legs are capable of moving freely as the body travels along the thread from the first position to the second position.

13. The body in claim 11 further comprising a second attaching member unitarily formed proximate the bottom portion of the body the second attaching member being adapted to fold said second attaching member and said body such that the legs can be movable coupled within said gap and the body.

14. The assembly in claim 8 wherein said thread material is relatively thin, flexible and transparent such that when the thread material is viewed by the naked eye the material is nearly invisible.

* * * * *